US010125774B2

(12) United States Patent
Higuchi et al.

(10) Patent No.: US 10,125,774 B2
(45) Date of Patent: Nov. 13, 2018

(54) CENTRIFUGAL FAN

(71) Applicant: MINEBEA CO., LTD., Kitasaku-gun, Nagano (JP)

(72) Inventors: Yukihiro Higuchi, Fukuroi (JP); Naoya Murakami, Fukuroi (JP)

(73) Assignee: Minebea Co., Ltd., Nagano (JP)

( * ) Notice: Subject to any disclaimer, the term of this patent is extended or adjusted under 35 U.S.C. 154(b) by 306 days.

(21) Appl. No.: 14/950,201

(22) Filed: Nov. 24, 2015

(65) Prior Publication Data

US 2016/0153458 A1 Jun. 2, 2016

(30) Foreign Application Priority Data

Nov. 27, 2014 (JP) ..... 2014-239751

(51) Int. Cl.
*F04D 17/16* (2006.01)
*F04D 29/28* (2006.01)
*F04D 29/30* (2006.01)

(52) U.S. Cl.
CPC ..... *F04D 17/162* (2013.01); *F04D 29/283* (2013.01); *F04D 29/30* (2013.01)

(58) Field of Classification Search
CPC ..... F04D 17/162; F04D 29/283; F04D 29/30; F05D 2240/30; F05D 2240/301; F05D 2240/303; F05D 2240/304
USPC ..... 415/93, 97, 98, 101, 102; 416/223 B
See application file for complete search history.

(56) References Cited

U.S. PATENT DOCUMENTS

2007/0020085 A1* 1/2007 Takemoto ..... F04D 17/162 415/93
2007/0065279 A1* 3/2007 Lin ..... F04D 29/281 415/206
2013/0022449 A1* 1/2013 Japikse ..... F01D 17/143 415/94

FOREIGN PATENT DOCUMENTS

JP H07-279892 A 10/1995
JP 2003-206891 A 7/2003
JP 2005-337566 A 12/2005
JP 2012-180810 * 9/2012 ..... F04D 29/30
JP 2012-180810 A 9/2012

OTHER PUBLICATIONS

Machine Translation of JP2012-180810 Specification.*
Office Action dated Aug. 22, 2017 in the corresponding Japanese patent application No. 2014-239751.

* cited by examiner

*Primary Examiner* — Logan Kraft
*Assistant Examiner* — Justin A Pruitt
(74) *Attorney, Agent, or Firm* — Carrier Blackman & Associates, P.C.; Joseph P. Carrier; Jeffrey T. Gedeon

(57) ABSTRACT

A centrifugal fan includes: a casing; and an impeller that is attached to a rotation shaft of a motor, wherein the casing has an upper suction port and a lower suction port, wherein the impeller has a rotor hub, a plurality of blades arranged around the rotor hub in a circumferential direction, and a main plate coupled to the rotor hub and connects the blades in the circumferential direction, and wherein an inclination of an outer edge of the blades at an upper blade portion that is located above the main plate with respect to a plane parallel to the rotation shaft and an inclination of the outer edge of the blades at a lower blade portion that is located below the main plate with respect to the plane parallel to the rotation shaft are set to be in the same direction.

4 Claims, 7 Drawing Sheets

CENTRIFUGAL FAN

BACKGROUND OF THE INVENTION

1. Field of the Invention

The present invention relates to a centrifugal fan.

2. Description of the Related Art

In the related art, for the purpose of a decrease in thickness and size, a centrifugal fan has been proposed in which an impeller is received in a casing having a suction port and an air outlet (for example, see JP-A-2012-180810). In the configuration disclosed in JP-A-2012-180810, since an impeller is disposed in a casing, a draft angle is formed in outer-diameter portions of blades constituting the impeller, and the length of a cross-section in the vicinity of a suction port can be reduced, a wind speed is increased by efficiently sending wind suctioned from the suction port to the outer-diameter side (see FIG. 10 of JP-A-2012-180810).

However, in the centrifugal fan disclosed in JP-A-2012-180810, the draft angle of each blade is formed to have the same draft angle about the draft direction above and below a main plate. Accordingly, when an amount of air suctioned from the suction port varies above and below due to an influence of an opening area of the suction port below the blade, unevenness in wind speed occurs in the entire blade and thus there is a problem in that an air flow rate cannot be increased.

SUMMARY OF THE INVENTION

One of objects of the present invention is to provide a centrifugal fan that can increase an air flow rate by making a wind speed substantially uniform in an axial direction of a blade.

According to an illustrative embodiment of the present invention, there is provided a centrifugal fan including: a casing that has a base portion at a lower side, to which a motor unit is installed; and an impeller that is provided in the casing and attached to a rotation shaft of the motor to be rotatable with respect to the casing. The casing is provided with an upper suction port that is located at a position above the rotation shaft and a lower suction port that is located at a position below the rotation shaft. The impeller is provided with a rotor hub that is attached to the rotation shaft, a plurality of blades arranged around the rotor hub in a circumferential direction, and a main plate coupled to the rotor hub and connects the blades in the circumferential direction. An inclination of an outer edge of the blades at an upper blade portion that is located above the main plate with respect to a plane parallel to the rotation shaft and an inclination of the outer edge of the blades at a lower blade portion that is located below the main plate with respect to the plane parallel to the rotation shaft are set to be in the same direction.

DETAILED DESCRIPTION

Figure 1:
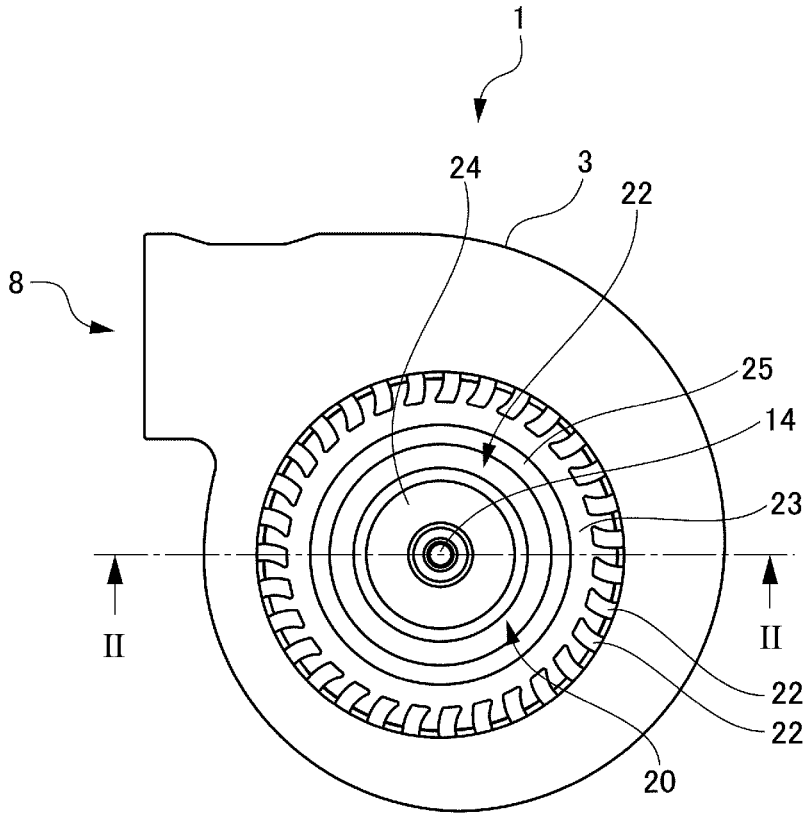
FIG. 1 is a plan view illustrating a centrifugal fan according to an embodiment of the present invention in a state in which an upper housing is removed.

Hereinafter, modes for carrying out the present invention (hereinafter, referred to as embodiments) will be described in detail with reference to the accompanying drawings. In the following description, like elements are referenced by like reference characters.

Figure 2:
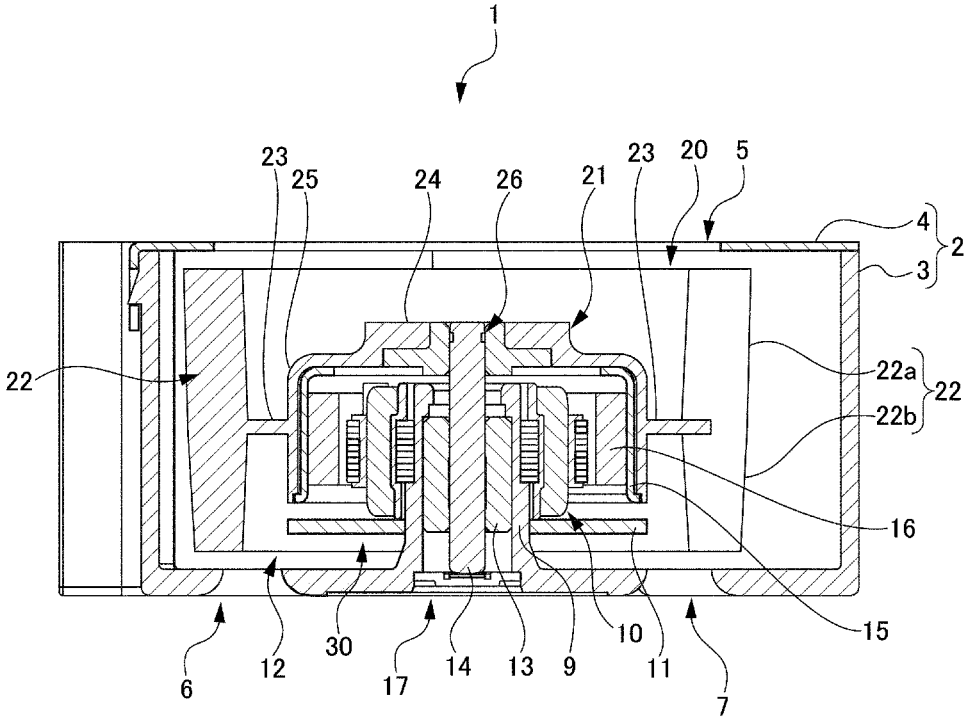
FIG. 2 is a longitudinal cross-sectional view of the centrifugal fan according to the embodiment of the present invention.
Figure 3:
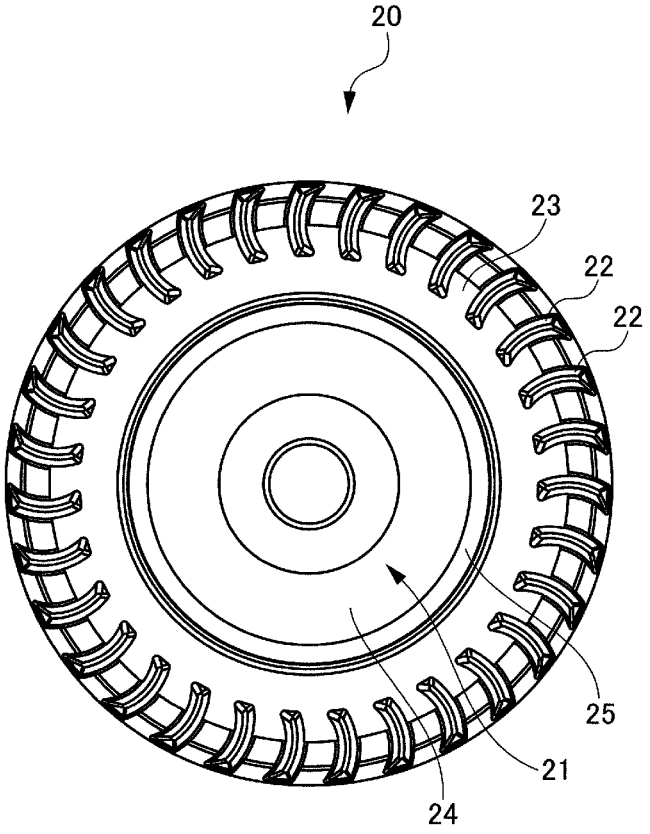
FIG. 3 is a bottom view of an impeller of the centrifugal fan according to the embodiment of the present invention.

FIG. 1 is a plan view of a centrifugal fan according to an embodiment of the present invention. FIG. 2 is a cross-sectional view taken along line II-II shown in FIG. 1. FIG. 3 is a bottom view of an impeller of the centrifugal fan according to the embodiment of the present invention.

As illustrated in FIGS. 1 to 3, a centrifugal fan 1 includes a casing 2, an impeller 20, and a motor unit 30. The casing 2 includes a lower casing 3 having a bottom and having a substantially cylindrical shape and an upper casing 4 formed on the lower casing 3. A circular upper suction port 5 located above a rotation shaft is formed in the upper casing 4, and lower suction ports 6 and 7 located below the rotation shaft and an air outlet located on a side surface are formed in the lower casing 3. The opening area of the upper suction port 5 is set to be larger than the opening areas of the lower suction ports 6 and 7.

In the centrifugal fan 1, a base portion 17 of the casing to which the motor unit 30 is fixed is formed on a lower side. A tubular sleeve 9 which is fixed upright to the lower casing 3 is formed in the base portion 17. A stator 10 including a laminated core having a winding is formed on the outer circumferential portion of the sleeve 9. A board 11 which is electrically connected to a winding end of the stator 10 and on which a circuit for driving a motor is formed is disposed below the stator 10. A rotor 12 rotates by receiving a magnetic force from the stator 10.

A cylindrical bearing 13 is inserted into the sleeve 9, and one end of a shaft 14 as a rotation shaft which is rotatably supported in the sleeve 9 is attached and fixed to the center of the rotor 12 by the bearing 13. The rotor 12 includes a yoke 15 disposed to surround the stator 10, a permanent magnet 16 formed on the inner circumferential surface of the yoke 15, and an impeller 20 formed of a resin. By applying a predetermined current to the winding of the stator 10 via the board 11, an attractive force and a repulsive force with respect to the permanent magnet 16 facing the stator 10 are generated and the rotor 12 rotates around the shaft 14.

As illustrated in FIGS. 2 and 3, the impeller 20 is formed in the casing 2 and includes a rotor hub 21, plural blades 22 formed in the circumferential direction around the rotor hub 21 so as to be radial from the shaft 14, and a main plate 23 which is coupled to the rotor hub 21 to connect the blades 22 in the circumferential direction. The rotor hub 21 has a cup shape as a whole and includes a base 24 formed on a side facing the upper suction port 5 and a cylindrical tubular portion 25 extending to be separated from the upper suction port 5 along the axial direction of the rotor 12 from the outer circumferential end face of the base 24. One end of the shaft 14 is fitted and fixed to a fitting portion 26 formed at the center of the base 24. The inner surface of the tubular portion 25 is formed as an attachment portion of the yoke 15 and the ring-shaped main plate 23 is formed on the outer circumferential surface of the tubular portion 25. The main plate 23 is formed in the middle of the plural blades 22 and is formed to connect the plural blades 22. The plural blades 22 have a shape which is curved at the same curvature with the same size.

Figure 4:
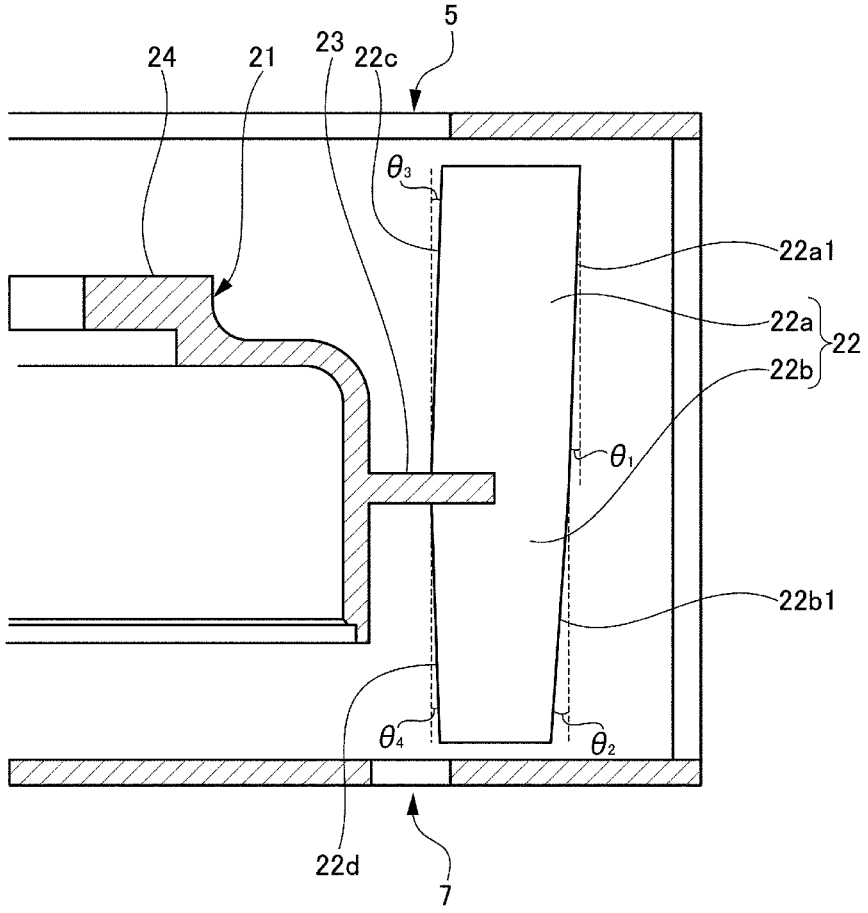
FIG. 4 is a diagram illustrating a blade of the centrifugal fan according to the embodiment of the present invention.

FIG. 4 is a diagram illustrating a blade of the centrifugal fan according to the embodiment of the present invention. As illustrated in FIG. 4, in a case where an inclination is formed in an inner-diameter portion and an outer-diameter portion of each blade 22, it is necessary to consider a draft angle for drafting a mold in molding the impeller 20. In the outer-diameter portion of each blade 22, an inclination 22*a*1 (an inclination angle θ1) of an upper blade portion 22*a* located above the main plate 23 in an outer-side side surface (outer edge) of the blade 22 about a plane parallel to the rotation shaft and an inclination 22*b*1 (an inclination angle θ2) of a lower blade portion 22*b* located below the main plate 23 about the plane parallel to the rotation shaft are formed in the same direction. The inclination 22*b*1 of the lower blade portion 22*b* can be set to be larger than the inclination 22*a*1 of the upper blade portion 22*a*. In the example illustrated in the drawing, two-step inclination angles are formed in the upper blade portion and the lower blade portion, but plural inclination angles may be additionally formed. The length of a blade cross-section of each blade 22 in a direction perpendicular to the rotation shaft continuously decreases from the upper blade portion 22*a* to the lower blade portion 22*b*, and the outer diameter of each blade 22 decreases from the upper blade portion 22*a* to the lower blade portion 22*b*.

In the inner-diameter portion of each blade 22, the upper blade portion 22*a* and the lower blade portion 22*b* have draft angles 22*c* and 22*d* having a shape which is inclined toward the outer-diameter side. In other words, an inner-side side surface (inner edge) of the upper blade portion 22*a* and an inner-side side surface (inner edge) of the lower blade portion 22*b* are configured to have draft angles 22*c* and 22*d* that are inclined toward the outer-diameter side. The inner-side side surfaces of the upper blade portion 22*a* and the lower blade portion 22*b* are configured to be closest to the rotor hub 21 at a portion where the upper blade portion 22*a* and the lower blade portion 22*b* are jointed with the main plate 23. The draft angle on the inner-diameter side of each blade 22 is formed in the opposite directions in the upper blade portion 22*a* and the lower blade portion 22*b* with the main plate 23 as a boundary. Here, the draft angle 22*c* of the inner-diameter portion of the upper blade portion 22*a* is inclined by an inclination angle θ3, and the draft angle 22*d* of the inner-diameter portion of the lower blade portion 22*b* is inclined by an inclination angle θ4. The draft angle in the inner-diameter portion of each blade can be determined by the length of the blade cross-section and the inclination of the outer diameter. Since the draft angle for a mold is formed in the blade cross-section in comparison with a cross-section determined in a design, it is necessary to enlarge or reduce the cross-sectional shape depending on the draft angle. When the draft angle is constant, the cross-sectional shape varies and thus a desired air flow rate can be obtained in a cross-sectional portion closer to a designed value, but where it differs from the designed cross-section the cross-section air flow rate decreases. Therefore, in this embodiment, the wind speeds above and below in the blade axis direction are made to be uniform to enhance the air flow rate without depending on the draft angle by forming an inclination on the outer-side side surface of each blade 22 and additionally changing the inclination angles of the upper blade portion 22*a* and the lower blade portion 22*b* in the middle in the blade axis direction.

Figure 5A:
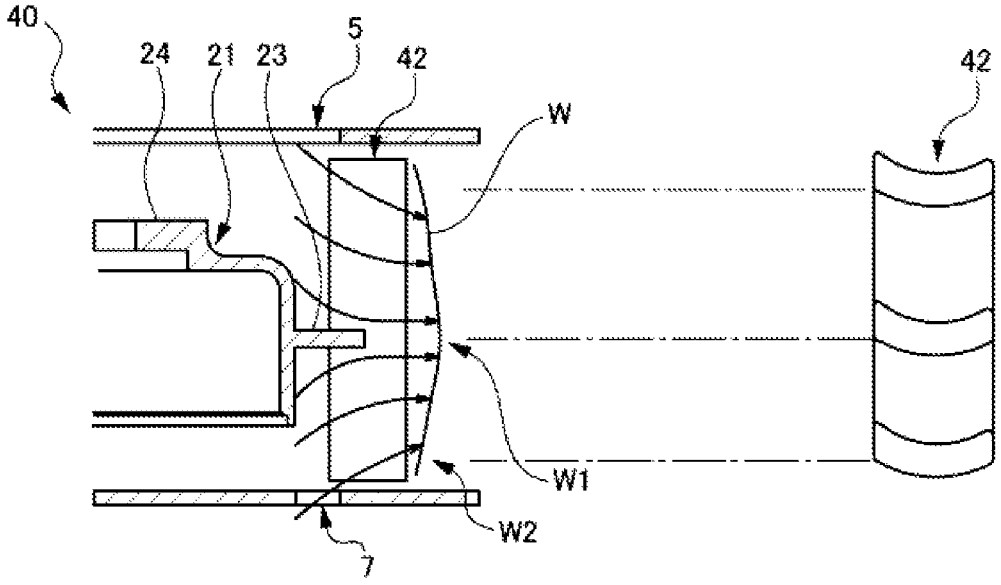
FIGS. 5A to 5C are diagrams illustrating blade configurations and air flows of centrifugal fans according to the embodiment of the present invention and comparative examples.
Figure 5B:
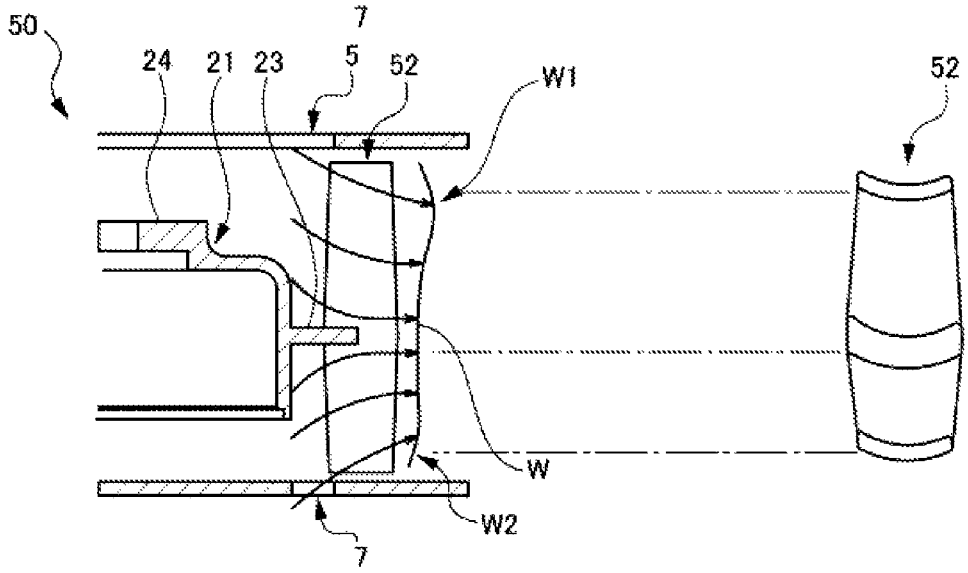
Figure 5C:
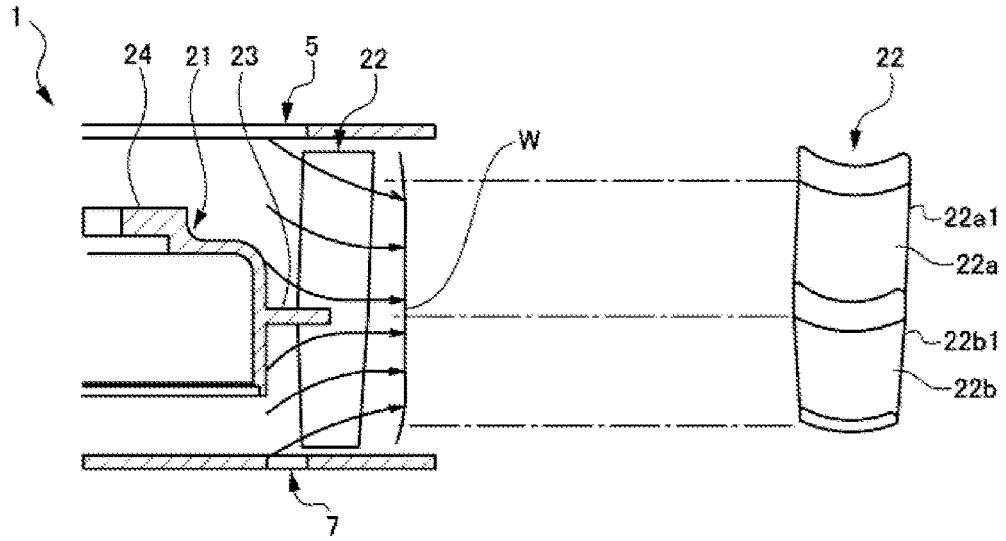

In the embodiment, the outer-side side surface and the inner-side side surface of each blade 22 are configured to have a thin flat shape having a width in circumferential direction as shown in FIGS. 1, 3 and 5C. The outer-side side surface and the inner-side side surface of each blade 22 define the outer edge and the inner edge of the blade 22 respectfully when the blade 22 is viewed from the circumferential direction or a tangential direction of the impeller 20. The outer-side side surface and the inner-side side surface of each blade 22 may be configured to have a constant width as shown in FIG. 5A, or may be configured to have different width at each portion of the blade 22 as shown in FIGS. 5B and 5C. Noting that FIGS. 5A and 5B show Comparative Examples 1 and 2 as described in below, these figures are referred to in this paragraph for explaining exemplary modifications of the blade 22 with different width of the outer-side side surface and the inner-side side surface.

The outer-side side surface and the inner-side side surface of each blade 22 may be configured to have a very small width (i.e. to have sharp outer and inner edges).

The outer-side side surface and the inner-side side surface of each blade 22 may alternatively be configured to have a rounded surface that is formed to be smoothly connected to a front face and a back face of the blade 22. In this case, a ridge line of the rounded outer-side side surface and the rounded inner-side side surface define the outer edge and the inner edge of the blade 22 respectively When it is necessary to further increase the wind speed of a part of the upper blade portion 22*a* closer to the upper suction port 5, the length of the blade cross-section can be decreased by increasing the draft angle 22*c* (the inclination angle θ3) of the inner-diameter portion of the blade 22 and decreasing the inclination of the outer-diameter portion of the blade 22. On the other hand, in the lower part of the blade 22, the length of the blade cross-section in a part of the blade 22 closer to the lower suction port 7 can be made to be smaller than the length of the blade cross-section in a part of the blade 22 closer to the upper suction port 5 by setting the inclination 22*b*1 of the outer-diameter portion of the lower blade portion 22*b* to be larger than the inclination 22*a*1 of the upper blade portion 22*a*. Accordingly, it is possible to increase an air flow rate by making the wind speed substantially uniform in the axial direction of each blade 22.

FIGS. 5A to 5C are diagrams illustrating blade configurations and air flows of centrifugal fans according to the embodiment of the present invention and comparative examples. FIG. 5A is a diagram illustrating a centrifugal fan according to Comparative Example 1 in which no draft angle is formed in the inner-diameter portion and the outer-diameter portion of each blade. FIG. 5B is a diagram illustrating a centrifugal fan according to Comparative Example 2 in which a draft angle is formed in the inner-diameter portion and the outer-diameter portion of each blade. FIG. 5C is a diagram illustrating the centrifugal fan according to the embodiment of the present invention. In FIGS. 5A to 5C, when the rotor including the impeller rotates, air is suctioned in a suction direction of the impeller from the upper suction port 5 and the lower suction port 7, the air flow is changed by the centrifugal force of the rotor, and the air flows out from the air outlet of the casing. These air flows are indicated by arrows. Reference character W indicates a line schematically illustrating an air flow rate, and indicates that the wind speed is high in the vicinity of W1 having a large height and the wind speed is low in the vicinity of W2 having a small height. The blade cross-sections at the positions of the blade are illustrated on the right side in FIGS. 5A to 5C. In the drawings, the left is the inner-diameter side and the right is the outer-diameter side.

As illustrated in FIG. 5A, in the centrifugal fan 40 according to Comparative Example 1, when no draft angle is formed in the inner-diameter portion and the outer-diameter portion of the blade 42, air flowing in from the upper suction port 5 and the lower suction port 7 obliquely cross the blade 42 in the vicinity of the upper suction port 5 and the lower suction port 7 and thus the wind speed decreases. In the vicinity of the main plate 23, the air crosses the blade 42 substantially perpendicularly and thus the wind speed increases. In addition, the upper suction port 5 of the blade 42 has a large opening and has a high air flow rate, but the lower suction port 7 of the blade 42 does not have a large opening due to the base portion for fixing the motor to the case or spokes for connection to the outer circumferential portion of the case and thus cannot increase the air flow rate. Therefore, the wind speed in the lower portion of the blade 42 is lower than that in the upper portion of the blade 42 and this unevenness in wind speed causes a decrease in air flow rate. This is because a phenomenon in which air is separated from the blade occurs in a part having a high wind speed and interferes with air flowing to the outside.

As illustrated in FIG. 5B, in the centrifugal fan 50 according to Comparative Example 2, when a draft angle is formed in both the inner-diameter portion and the outer-diameter portion of the blade 52 with the main plate 23 as a boundary (the inclination is vertically symmetric in this example), the length of the blade cross-section in the vicinity of the upper suction port 5 and the lower suction port 7 can be reduced. Accordingly, since air suctioned from the upper suction port 5 and the lower suction port 7 can be rapidly sent to the outer-diameter side, it is possible to increase the wind speed. However, when the draft angle is uniformly formed above and below the main plate 23, it is not possible to cope with a problem in which amounts of air suctioned from the suction ports are different between above and below in the lower portion of the blade 52 and thus there is a possibility that unevenness in wind speed will occur in the entire blade 52.

As illustrated in FIG. 5C, in the centrifugal fan 1 according to the embodiment of the present invention, the inclination 22*a*1 of the upper blade portion 22*a* and the inclination 22*b*1 of the lower blade portion 22*b* with the main plate 23 as a boundary are formed in the same direction on the outer-diameter side of the blade 22. In addition, the inclination 22*b*1 of the lower blade portion 22*b* is set to be larger than the inclination 22*a*1 of the upper blade portion 22*a*. Accordingly, the air flow in the upper blade portion 22*a* does not have a large difference between the vicinity of the upper suction port 5 and the lower suction port 7 and the length of the blade cross-section of the lower blade portion 22*b* in the vicinity of the lower suction port 7 can be set to be extremely small. Accordingly, it is possible to increase the wind speed in the blade 22 in the vicinity of the lower suction port 7 and thus to make the wind speed substantially uniform in the entire blade 22, thereby increasing the air flow rate.

Figure 6:
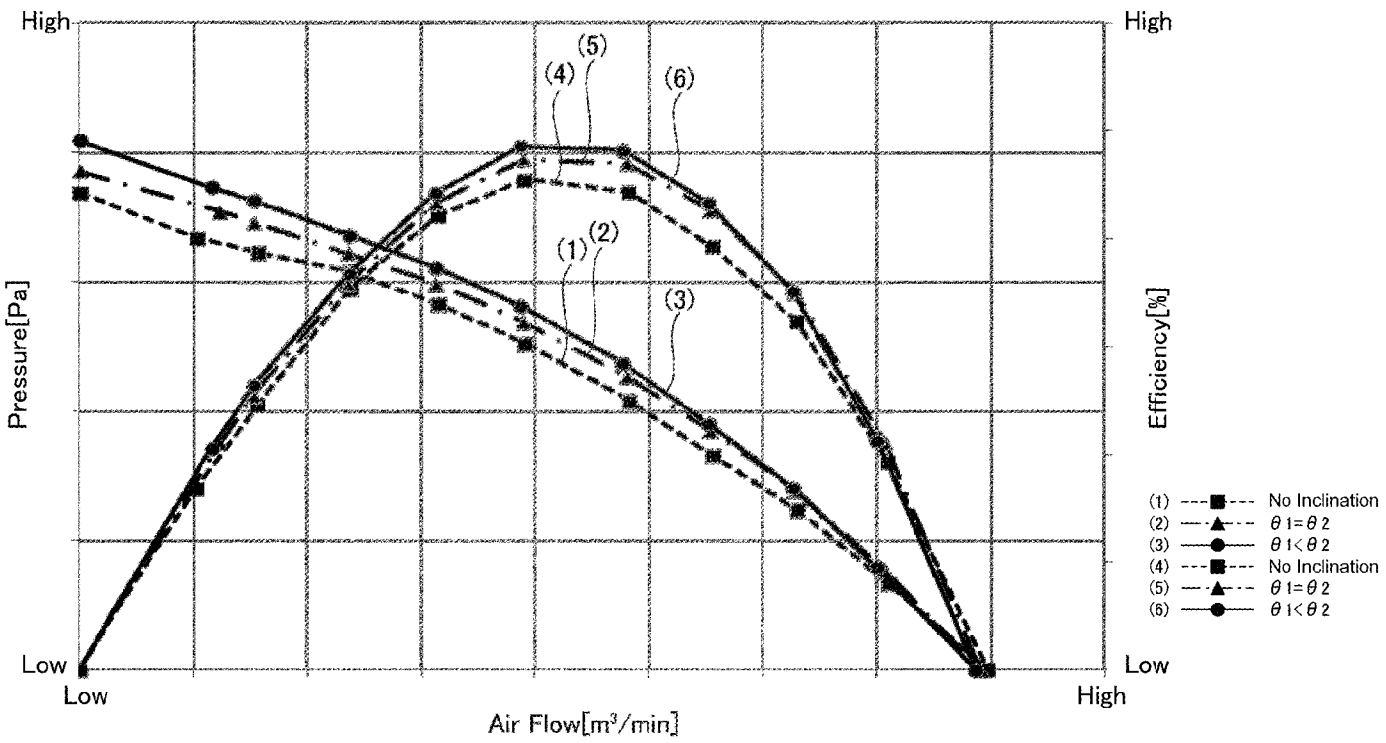
FIG. 6 is a diagram illustrating air flow rate-static pressure characteristics (P-Q characteristics) of the centrifugal fans in the embodiment of the present invention and the comparative examples.

FIG. 6 is a diagram illustrating air flow rate-static pressure characteristics (P-Q characteristics) of the centrifugal fans according to the embodiment of the present invention and the comparative examples. In FIG. 6, the horizontal axis represents the air flow rate, the left vertical axis represents the static pressure, and the right vertical axis represents the efficiency. In the drawing, characteristic (1) indicates the P-Q characteristic when no inclination is formed in the upper blade portion 22*a* and the lower blade portion 22*b* ($\theta 1 = \theta 2$=zero degree), characteristic (2) indicates the P-Q characteristic when the same inclination is formed in the upper blade portion 22*a* and the lower blade portion 22*b* ($\theta 1 = \theta 2$), and characteristic (3) indicates the P-Q characteristic when the inclination formed in the lower blade portion 22*b* is larger than the inclination formed in the upper blade portion 22*a* ($\theta 2 > \theta 1$). As indicated by characteristics (1) and (2), the P-Q characteristic is improved by forming the inclinations in the same direction in the upper blade portion 22*a* and the lower blade portion 22*b*. As indicated by characteristics (2) and (3), the P-Q characteristic is further improved by setting the inclination 22*b* 1 of the lower blade portion 22*b* having a smaller opening to be larger than the inclination 22*a*1 of the upper blade portion 22*a*.

Characteristic (4) indicates the air flow rate-efficiency characteristic when no inclination is formed in the upper blade portion 22*a* and the lower blade portion 22*b* ($\theta 1 = \theta 2$=zero degree), characteristic (5) indicates the air flow rate-efficiency characteristic when the same inclination is formed in the upper blade portion 22*a* and the lower blade portion 22*b* ($\theta 1 = \theta 2$), and characteristic (6) indicates the air flow rate-efficiency characteristic when the inclination formed in the lower blade portion 22*b* is larger than the inclination formed in the upper blade portion 22*a* ($\theta 2 > \theta 1$). As indicated by characteristics (4) and (5), the efficiency is improved by forming the inclinations in the same direction in the upper blade portion 22*a* and the lower blade portion 22*b*. As indicated by characteristics (5) and (6), the efficiency is further improved by setting the inclination 22*b*1 of the lower blade portion 22*b* having a smaller opening to be larger than the inclination 22*a*1 of the upper blade portion 22*a*.

As described in the above with reference to the embodiment, according to the present invention, it is possible to provide a centrifugal fan that can increase an air flow rate by making a wind speed substantially uniform in an axial direction of a blade.

While the present invention has been described above with reference to the embodiment, the technical scope of the present invention is not limited to the scope of the embodiment. It will be apparent to those skilled in the art that the embodiment can be modified and improved in various forms. It will be understood from the appended claims that the modifications or improvements of the embodiment belong to the technical scope of the present invention.

What is claimed is:

1. A centrifugal fan comprising:

a casing that has a base portion at a lower side, to which a motor unit is installed; and an impeller that is provided in the casing and attached to a rotation shaft of the motor to be rotatable with respect to the casing, wherein the casing is provided with an upper suction port that is located at a position above the rotation shaft and a lower suction port that is located at a position below the rotation shaft, wherein the impeller is provided with a rotor hub that is attached to the rotation shaft, a plurality of blades arranged around the rotor hub in a circumferential direction, and a main plate coupled to the rotor hub and connects the blades in the circumferential direction, wherein each of the blades has an upper blade portion that is located above the main plate and a lower blade portion that is located below the main plate, wherein an outer circumferential portion of the upper blade portion has a first inclination that is inclined from an upper outer circumferential edge of the upper blade portion to a boundary portion between the upper blade portion and the lower blade portion with respect to a plane parallel to the rotation shaft, wherein an outer circumferential portion of the lower blade portion has a second inclination that is inclined from the boundary portion to a lower outer circumferential edge of the lower blade portion with respect to the plane parallel to the rotation shaft, wherein the first inclination and the second inclination are inclined inward in the same direction, and wherein the second inclination of the outer circumferential portion of the lower blade portion is set to be lamer than the first inclination of the outer circumferential portion of the upper blade portion.

2. The centrifugal fan according to claim 1, wherein an inner circumferential portion of the blades at the upper blade portion and an inner circumferential portion of the blades at the lower blade portion are configured to have a draft angle and inclined toward an outer-diameter side.

3. The centrifugal fan according to claim 1, wherein an opening area of the upper suction port is set to be larger than an opening area of the lower suction port.

4. The centrifugal fan according to claim 1, wherein a length of a blade cross-section of each of the blades taken in a plane perpendicular to the rotation shaft is configured to gradually decrease from an upper part of the blades to a lower part of the blades.

* * * * *